US008015731B2

(12) United States Patent
Jackson

(10) Patent No.: US 8,015,731 B2
(45) Date of Patent: Sep. 13, 2011

(54) INTERCHANGEABLE FASHION COVERING FOR A HIGH HEEL SHOE

(76) Inventor: Bettye Jackson, Mobile, AL (US)

( * ) Notice: Subject to any disclaimer, the term of this patent is extended or adjusted under 35 U.S.C. 154(b) by 846 days.

(21) Appl. No.: 11/968,182

(22) Filed: Jan. 1, 2008

(65) Prior Publication Data

US 2009/0165335 A1 Jul. 2, 2009

(51) Int. Cl.
*A43B 3/24* (2006.01)

(52) U.S. Cl. ..... 36/101; 36/7.2; 36/7.4

(58) Field of Classification Search ..... 36/101, 36/7.2, 7.4, 135, 100, 72 R
See application file for complete search history.

(56) References Cited

U.S. PATENT DOCUMENTS

| | | | | | |
|---|---|---|---|---|---|
| 1,336,962 | A | * | 4/1920 | Joseph | 36/7.4 |
| 1,805,398 | A | | 5/1931 | Helfant | |
| 1,888,172 | A | * | 11/1932 | Joha | 66/177 |
| 2,257,901 | A | * | 10/1941 | De Noronha | 36/7.4 |
| 2,391,429 | A | | 12/1945 | Lipari | |
| 2,432,947 | A | * | 12/1947 | Thompson | 36/7.2 |
| 2,587,205 | A | | 2/1952 | Paster | |
| 2,873,540 | A | * | 2/1959 | Murphy | 36/101 |
| 3,012,340 | A | * | 12/1961 | Reinhart | 36/101 |
| 3,032,896 | A | | 5/1962 | Weaver | |
| 3,373,510 | A | * | 3/1968 | Memole et al. | 36/100 |
| 4,267,649 | A | * | 5/1981 | Smith | 36/101 |
| 4,268,931 | A | * | 5/1981 | Salomon | 12/146 R |
| 5,496,612 | A | | 3/1996 | Ransbottom | |
| 6,848,199 | B1 | | 2/2005 | Giannelli | |
| 7,200,959 | B2 | | 4/2007 | Spann | |
| 2004/0093765 | A1 | | 5/2004 | Baldwin | |

* cited by examiner

*Primary Examiner* — Ted Kavanaugh
(74) *Attorney, Agent, or Firm* — Louis Ventre, Jr.

(57) ABSTRACT

An interchangeable glove-like covering for the toe end of a woman's high heel shoe that is used to change the visual appearance of the shoe. The covering has an upper portion and a lower portion that are mated to each other so as to form a closed end and an open end in the shape of the front end of the shoe. The upper portion is used to cover the top part of the toe end of the shoe and the lower portion is used to cover the sole of the shoe at the toe end. The lower portion has a slit extending from the open end and ending before the closed end to facilitate pulling the covering over the toe end of the shoe.

3 Claims, 2 Drawing Sheets

INTERCHANGEABLE FASHION COVERING FOR A HIGH HEEL SHOE

FIELD OF INVENTION

In the field of apparel, the invention is a replaceable ornamental covering for a woman's high heel shoe.

BACKGROUND OF THE INVENTION

The preferred embodiment of the invention is a glove-like shoe covering for the front end of a woman's high heel shoe, which may be used to easily change the ornamentation on a shoe. The covering fits over the entire front end of a high heel shoe, covering both upper and sole portions of the front end of the shoe. A snug fit and a rubber sole of the covering assures that the covering stays on the shoe without snaps or clips or other mechanical attaching means that could otherwise mar the shoe. The covering permits a person to easily change the decoration of a shoe to match the fashion requirements of the occasion, or simply to match the rest of the person's apparel.

DESCRIPTION OF PRIOR ART

The prior art in this category relates primarily to replacement of the upper part of a shoe covering the instep. Termed a vamp, this part of the shoe does not include the sole of the shoe. The present invention includes a sole and is distinct from the prior art.

Prior art in this category teaches a cover for the vamp, which is affixed using snaps, elastics or other such means. Often the shoe itself must have mating snaps, which is a requirement that limits the usefulness of the covering for regular high heel shoes. The present invention eliminates the need for mating snaps on the shoe, or other alterations that deface the shoe.

Because covering a vamp can be particularly difficult if it occupies the entire upper portion of the toe area, the prior art in this area is directed at shoes having an open toe at the tip where the woman's toes are visible. The present invention solves this problem and provides a means for covering closed-toe shoes.

An example of the prior art in this area is U.S. Pat. No. 3,032,896 for a convertible shoe having a replaceable vamp cover. The '896 patent teaches a vamp on an open toe shoe that has three spaced female snap fastener elements. These are releasably engageable by complementary male snap fastener elements on the underside of the vamp cover. The present invention is different in that it is a glove-like cover that includes a sole, does not require an open toe shoe, covers the entire front end of a shoe, and does not use snaps or other such mechanical attaching means.

Accordingly, the present invention will serve to improve the state of the art by providing a snug-fitting, glove-like ornamental covering for a woman's high heel shoe that covers the front end of a shoe and does not use snaps or other such mechanical attaching means that could otherwise deface the shoe. The covering permits a person to easily change the decoration and appearance of a shoe to match the fashion requirements of the occasion.

BRIEF SUMMARY OF THE INVENTION

An interchangeable glove-like covering for the toe end of a woman's high heel shoe that is used to change the visual appearance of the shoe. The covering has an upper portion and a lower portion that are mated to each other so as to form a closed end and an open end in the shape of the front end of the shoe. The upper portion is used to cover the top part of the toe end of the shoe and the lower portion is used to cover the sole of the shoe at the toe end. When placed on a shoe, the closed end of the covering is at the tip of the toe end of the shoe. The lower portion has a slit extending from the open end and ending before the closed end to facilitate pulling the covering over the toe end of the shoe. Preferred embodiments of the covering have an upper part made of cloth or leather, lower part made of durable rubber and a slit ending in a circular cutout to minimize slit progression. Alternative embodiments of the covering have a closed end shaped to a high heel shoe with a pointed toe, square toe, or round toe.

BRIEF DESCRIPTION OF THE DRAWINGS

The reference numbers in the drawings are used consistently throughout.

DETAILED DESCRIPTION

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural and operational changes may be made without departing from the scope of the present invention.

Figure 1:
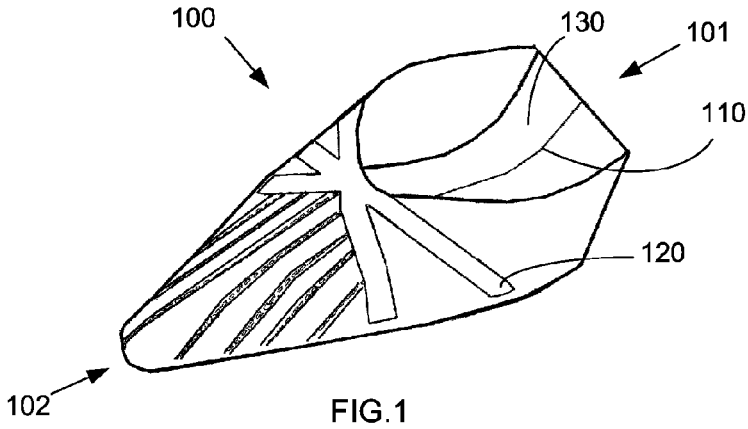
FIG. 1 is a perspective of a preferred embodiment of the covering.
Figure 2:
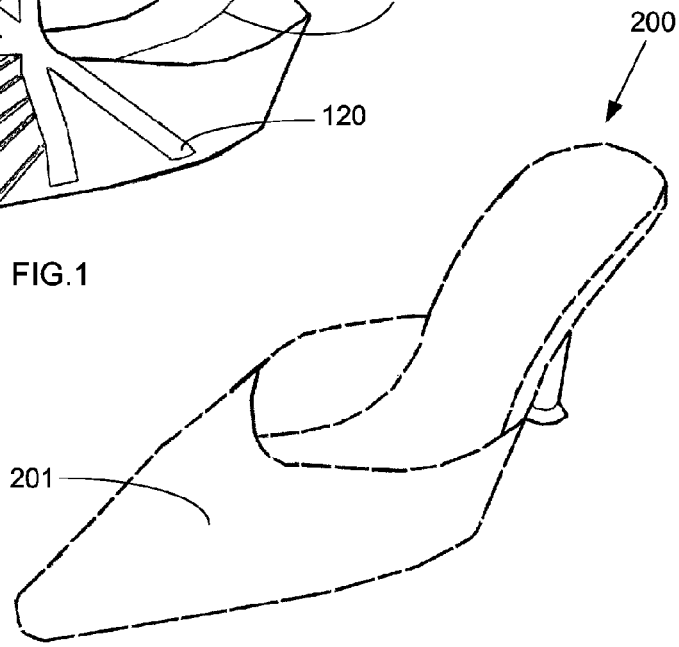
FIG. 2 is a perspective of a high heel shoe on which the covering would be used.

FIG. 1 and FIG. 2 should be viewed together to more easily understand the invention. FIG. 1 shows a perspective view of a preferred embodiment of the covering (100) for a high heel shoe, which is in the shape of the front end of a shoe (200), shown in perspective in FIG. 2.

When placed on the shoe, the covering (100) is intended to change the visual appearance of the shoe by changing the ornamentation (120) on the upper or top part of the toe end of the shoe. The ornamentation can be as varied as the imagination and include various colors, beads, striping, or any other decoration suitable for a high heel shoe.

A shoe is typically composed of a sole and an upper or top part and the present invention is for a typical high heel shoe (200), one variety of which is shown in FIG. 2. A shoe can generally be described as having a toe end and a heel end. For purposes of this disclosure, the toe end extends from the tip of the toe end towards the heel end and terminates before the heel of the shoe. If the toe end of the shoe were separated from the heel end, it would resemble the shape of the covering (100) shown in FIG. 1.

The covering (100) has an upper portion that when placed on a shoe substantially covers a top part (201) of the toe end of the shoe, that is it covers the front part of the shoe that is most noticeable when a person walks in a shoe. The upper portion may be made of any material or any combination of materials. Preferably, the upper portion is substantially made of leather or cloth, leather and cloth, or leather and/or cloth in some combination with man-made materials. An example of a leather for the upper portion is suede.

The covering (100) has a lower portion (130) that is mated with the upper portion so as to form an open end (101) and a closed end (102).

Figure 3:
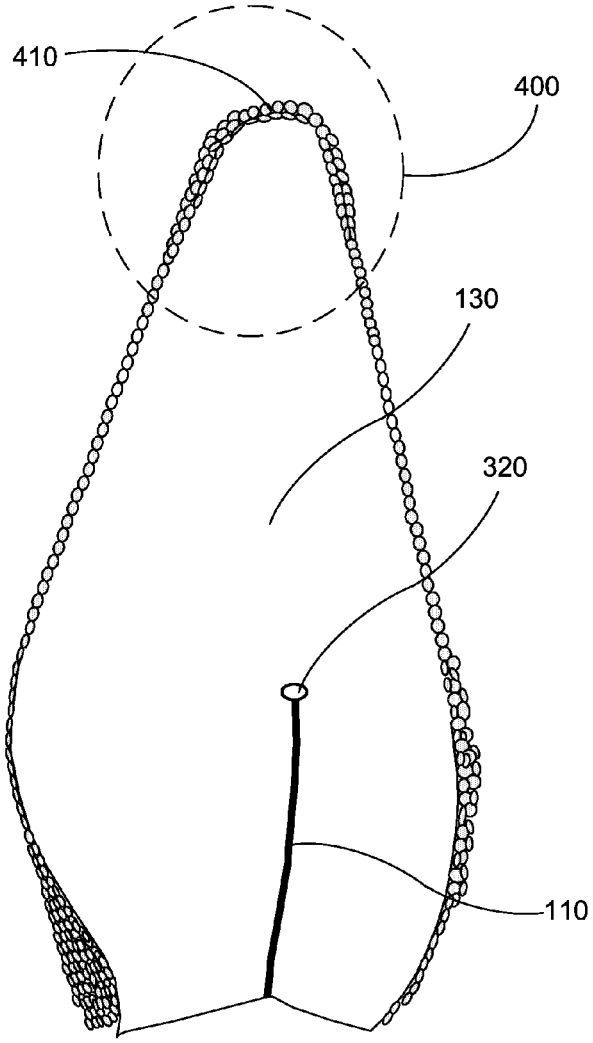
FIG. 3 is a bottom view of a preferred embodiment of the covering.

FIG. 3 shows a bottom view of the covering (100). The lower portion (130) substantially covers the sole of the shoe at the toe end when said covering (100) is placed on a shoe in a manner such that the closed end (102) is at the tip of the toe end of the shoe.

The lower portion (130) is made of a suitable sole material having a slit (110) extending from the open end (101) and ending before the closed end, preferably ending about halfway from the open end (101) to the closed end (102). The slit (110) is preferably just long enough to enable enlarging the open end (101) to fit over the widest portion of the toe end of the shoe. The lower portion (130) is preferably made of a durable rubber typically used for soles of shoes, which has desirable properties of being stretchable, resistant to tearing and able to readily return to its unstretched form. In alternative embodiments, the slit (110) ends in a circular opening (320), as shown in FIG. 3, that helps resist slit propagation when the lower portion (130) is placed on the shoe.

Figure 4:
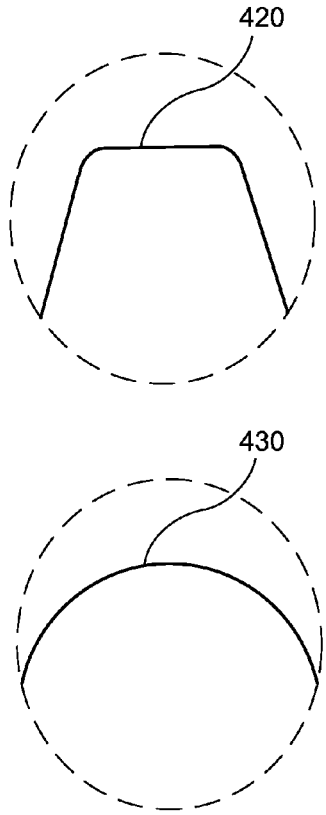
FIG. 4 is a top view of two alternative shapes for the toe end of the covering.

The covering may be in any shape complementary to the variety of high heel shoes that are available. For example, the most common high heel shoes come with a pointed toe, square toe, or round toe at the tip of the toe end of the shoe. The covering shown in FIG. 3 is for a typical pointed-toe shoe. The covering closed end for a pointed-toe (410) is illustrated at the dotted circle (400), which is carried forward in FIG. 4 to show the other exemplary closed end shapes, namely, a square-toe (420) and a rounded-toe (430).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

What is claimed is:

1. An improvement to a shoe, the shoe comprising a high heel, a sole, a toe end and a heel end, the toe end comprising a tip, wherein said toe end extends from the tip of the toe end towards the heel end and terminates before the high heel, the improvement comprising:

a covering having a shape corresponding to a shape of the toe end of the shoe and only covering the front toe end of the shoe, the covering comprising:

an upper portion that when placed on a shoe substantially covers a top part of the toe end of the shoe;

a lower portion that is mated with the upper portion so as to form a closed end and an open end;

said lower portion substantially covers the sole of the shoe at the toe end when said covering is placed on a shoe in a manner such that the closed end is at the tip of the toe end of the shoe; and said lower portion made of rubbery stretchable material, resistant to tearing and able to readily return to its unstretched form, the lower portion comprising a centrally-located slit extending from the open end and ending before the closed end to enable enlarging the open end to fit over the widest portion of the toe end of the shoe.

2. The covering of claim 1 wherein the slit ending comprises a circular opening.

3. The covering of claim 1 wherein the upper portion is substantially made of a material selected from a group consisting of cloth and leather.

* * * * *